United States Patent [19]

Holschuh

[11] Patent Number: 4,977,868

[45] Date of Patent: Dec. 18, 1990

[54] MECHANICAL COMPRESSION RELEASE SYSTEM

[75] Inventor: Mark T. Holschuh, Fond du lac, Wis.

[73] Assignee: Tecumseh Products Company, Tecumseh, Mich.

[21] Appl. No.: 378,829

[22] Filed: Jul. 12, 1989

[51] Int. Cl.[5] ..... F01L 13/08

[52] U.S. Cl. ..... 123/182

[58] Field of Search ..... 123/182, 90.16, 316

[56] References Cited

U.S. PATENT DOCUMENTS

| | | | |
|---|---|---|---|
| 3,362,390 | 1/1968 | Esty | 123/182 |
| 3,381,676 | 5/1968 | Campen | 123/182 |
| 3,395,689 | 8/1968 | Kruse | 123/182 |
| 3,496,922 | 2/1970 | Campen | 123/182 |
| 3,897,768 | 8/1975 | Thiel | 123/182 |
| 3,901,199 | 8/1975 | Smith | 123/182 |
| 3,981,289 | 9/1976 | Harkness | 123/182 |
| 4,453,507 | 6/1984 | Braun et al. | 123/182 |
| 4,610,227 | 9/1986 | Nakano et al. | 123/182 |
| 4,672,930 | 6/1987 | Sumi | 123/182 |
| 4,696,266 | 9/1987 | Harada | 123/182 |

FOREIGN PATENT DOCUMENTS

| | | | |
|---|---|---|---|
| 62-265414 | 11/1987 | Japan | 123/182 |

*Primary Examiner*—Andrew M. Dolinar

*Attorney, Agent, or Firm*—Jeffers, Hoffman & Niewyk

[57] ABSTRACT

A compression release mechanism for an internal combustion engine wherein a rotatable pin positioned axially parallel to the camshaft is rotatably received in the camshaft lobes, and has an auxiliary cam surface mounted at an axial end thereof. The auxiliary cam surface is adapted to extend above the outboard camshaft lobe to engage one of the valve lifters to thereby activate a compression release valve when the rotatable pin is rotated to a first position in response to low engine speed. The pin is rotated to a second position in response to high engine speed whereby the auxiliary cam surface is adapted so as not to engage the valve lifter. The pin is rotated by means of a centrifugally activated flyweight in response to engine speed.

20 Claims, 2 Drawing Sheets

MECHANICAL COMPRESSION RELEASE SYSTEM

BACKGROUND OF THE INVENTION

This invention relates generally to internal combustion engines, and more particularly to an improved compression release mechanism for four-stroke cycle engines.

Compression release mechanisms for four-stroke cycle engines are well known in the art Generally, means are provided to hold one of the valves in the combustion chamber of the cylinder head slightly open during the compression stroke while cranking the engine. This action partially relieves the force of compression in the cylinder during starting, so that starting torque requirements of the engine are greatly reduced. When the engine starts and reaches running speeds, the compression release mechanism is rendered inoperable so that the engine may achieve full performance. It is normally advantageous for the compression release mechanism to be associated with the exhaust valve so that the normal flow of the fuel/air mixture into the chamber through the intake valve, and the elimination of spent gases through the exhaust valve is not interrupted, and the normal direction of flow through the chamber is not reversed.

Examples of compression release mechanisms for four-stroke engines are shown in U.S. Pat. Nos. 3,381,676; 3,496,922; and 3,897,768; all assigned to the assignee of the present application. Although prior art compression release mechanisms are generally effective for relieving compression in the cylinder during cranking the engine, these prior art mechanisms are typically designed to provide compression relief when the exhaust valve is located inboard on the camshaft relative to the cam gear. U.S. Pat. Nos. 3,496,922 and 3,381,676 are examples of such compression release mechanisms. U.S. Pat. No. 3,897,768 discloses a compression release mechanism that is operable to actuate the exhaust valve when said valve is located outboard of the cam gear. Although this prior art mechanism performs satisfactorily, it has more working parts than is desired, and also imparts more friction to the system than is desired.

Accordingly, it is desired to provide a compression release mechanism that is effective in operation and relatively simple in construction, and that may be utilized to actuate the exhaust valve in an internal combustion engine wherein the exhaust valve is located outboard of the cam gear.

SUMMARY OF THE INVENTION

There is provided herein a compression release mechanism for an internal combustion engine that is operable to actuate a compression release valve positioned outboard of the camshaft gear during cranking of the engine.

The invention solves the problems of the prior art by providing a compression release mechanism for the purpose described above, that is relatively simple in operation and has few moving parts.

The invention comprises, in one form thereof, a compression release mechanism comprising a rotatable pin member positioned axially parallel to the camshaft. The pin includes an auxiliary cam surface at the axially outward end of the pin that is movable radially of the camshaft in response to the rotation of the pin. The pin is rotated by a centrifugally activated flyweight in response to engine speed. At low speeds the auxiliary cam surface is extended radially outward to actuate a compression release valve. At higher engine speeds, the auxiliary cam surface is retracted radially inward so as not to actuate the compression release valve. In order to provide the compression release action at the outboard exhaust valve, the flyweight is positioned adjacent the cam gear and the rotatable pin extends through the cam lobes to the auxiliary compression release cam surface located adjacent the outboard cam lobe.

An advantage of the present invention is that it provides an effective compression release mechanism that is operable to significantly reduce the cranking effort required to start an internal combustion engine without thereby sacrificing engine power and engine running speeds.

Another advantage of the present invention is that it provides a simplified compression release mechanism for an internal combustion engine that is operable to actuate the valve lifter associated with the camshaft lobe positioned outboard of the cam gear.

Yet another advantage of the present invention is that it provides a compression release mechanism of the type described that is relatively simple in operation and that has few moving parts.

A further advantage of the above invention is that it provides a compression release mechanism which is economical in construction and highly reliable in operation.

A still further advantage of the present invention is that the double bearing support for the rotatable pin member enables the member to rotate easier, and resists deflection of the member as it revolves with the camshaft.

The invention comprises, in one form thereof, a compression release mechanism for an internal combustion engine of the type having a combustion chamber, and intake and exhaust valves operable to respectively control the flow of a fuel/air mixture into the combustion chamber and the exhaust of gases therefrom. Respective intake and exhaust valve lifters are operable to actuate the valves. A rotatable camshaft having a camshaft gear fixed thereon includes inboard and outboard camshaft lobes fixed on the camshaft and axially spaced respective fixed distances from a first face of said camshaft gear. The inboard lobe is positioned axially on the camshaft between the camshaft gear and the outboard lobe, the inboard and outboard camshaft lobes being operable to engage respective valve lifters to actuate the intake and exhaust valves. The compression release mechanism comprises a rotatable pin axially parallel to the camshaft and rotatably received in the inboard and outboard camshaft lobes. The pin has a cam surface mounted at an axial end thereof and positioned adjacent the outboard lobe. The cam surface is adapted to extend above the outboard lobe to engage one of the valve lifters when the rotatable pin is rotated to a first position in response to low engine speed, and which is below the outboard lobe so as not to engage the valve lifter when the rotatable pin is rotated to a second position in response to high engine speed. A flyweight is connected to the other axial end of the rotatable pin, and is positioned between the inboard camshaft lobe and the camshaft gear. The flyweight is revolvable with the camshaft for rotating the pin cam surface to said first position below a threshold engine speed, and for rotating the pin cam surface to said second position above the threshold engine speed.

DESCRIPTION OF THE PREFERRED EMBODIMENT

Figure 1:
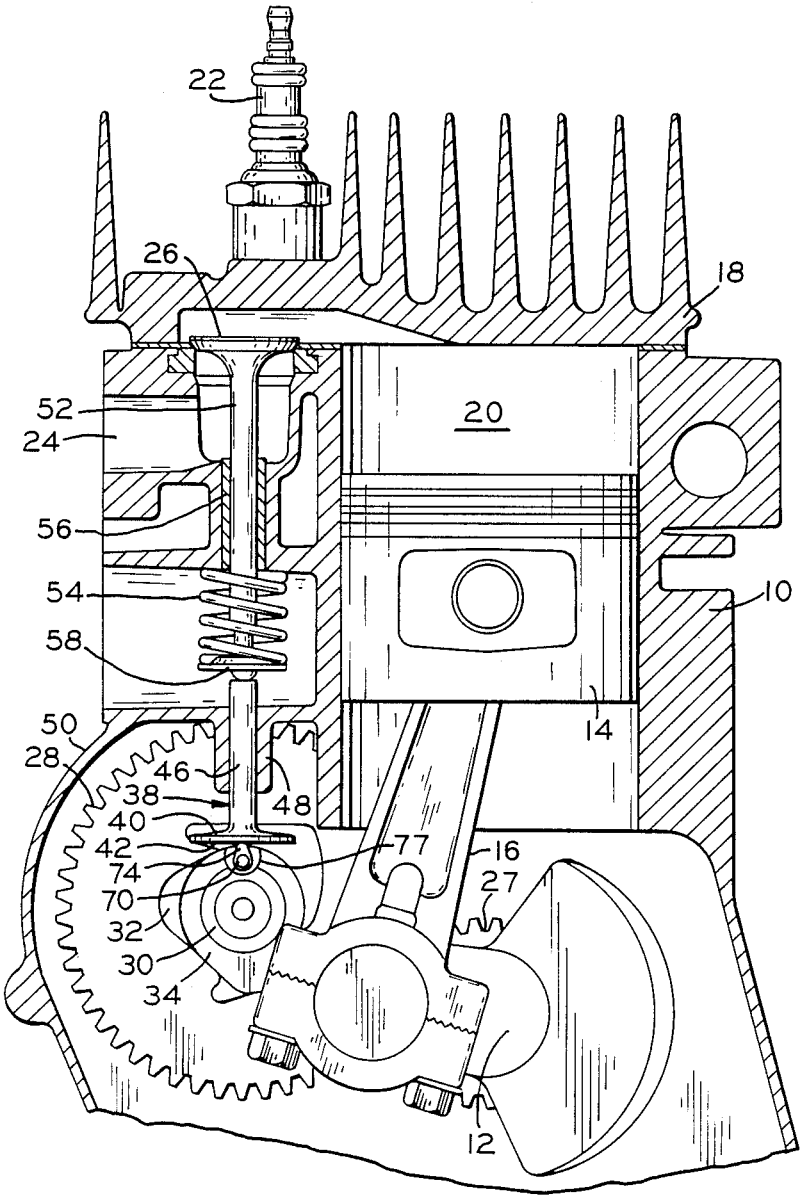
FIG. 1 is an elevational view, partly in section, of a single cylinder four-stroke internal combustion engine embodying the invention.

Referring now to the drawings and particularly to FIG. 1, there is shown a single cylinder four-stroke internal combustion engine including the compression release mechanism according to a preferred embodiment of the present invention. Although FIG. 1 illustrates a single cylinder four-stroke engine, the invention is not necessarily limited to this particular type of engine. As is customary, the engine shown in FIG. 1 has cylinder 10, crankshaft 12 and piston 14, the piston being operatively connected to crankshaft 12 through connecting rod 16. Piston 14 coacts with cylinder 10 and cylinder head 18 to define combustion chamber 20. Spark plug 22 secured in cylinder head 18 ignites the fuel/air mixture after it has been brought into combustion chamber 20 during the intake stroke and has been compressed during the compression stroke of piston 14. The spark is normally timed to ignite the fuel/air mixture just before piston 14 completes its ascent on the compression stroke. The fuel/air mixture is drawn into combustion chamber 20 from the carburetor of the engine through an intake passage controlled by a conventional intake valve (not shown), and the products of combustion are expelled from the cylinder during the exhaust stroke through exhaust port 24 controlled by poppet-type exhaust valve 26.

Other conventional parts of the valve operating mechanism include timing gear 27 mounted on crankshaft 12 for rotation therewith, and camshaft gear 28 mounted on camshaft 30 and rotatably driven by gear 27 to thereby rotate camshaft 30 at one-half crankshaft speed. Camshaft 30 comprises conventional pear-shaped intake and exhaust camshaft lobes 32 and 34, respectively, (FIGS. 2 and 4) which rotate with camshaft 30 to impart reciprocating motion to the intake and exhaust valves via flatfooted push rods 36 and 38, respectively. In the embodiment shown in the drawings, intake lobe 32 is the inboard lobe adjacent camshaft gear 28, and exhaust lobe 34 is outboard from camshaft gear 28 and lobe 32. In the preferred embodiment it will be recognized that exhaust valve 26 also functions as the compression release valve, in a manner to be discussed hereinafter.

The complete exhaust valve train is shown in FIG. 1 and includes push rod 38 which has circular follower 40 with flat underface 42 adapted to bear tangentially against and track upon periphery 44 of exhaust camshaft lobe 34. Stem 46 of push rod 38 slides in guide boss 48 of crankcase 50 and its upper end pushes against stem 52 of exhaust valve 26. In operation, push rod 38 and stem 52 collectively "lift" valve 26. Valve spring 54 encircles stem 52 between valve guide 56 and spring retainer 58 which is carried on stem 52. Spring 54 biases valve 26 closed and also biases push rod 38 into tracking contact with exhaust lobe 34.

The above-described engine and valve train parts are conventional. When the compression release mechanism to be described hereinafter is in its inoperative position, which is designated as the "run" position of the engine, the rotation of outboard lobe 34 with camshaft 30 causes normal operation of valve 26, so that it opens and closes in timed relation with the travel of piston 14 according to conventional engine timing practice. Thus, exhaust lobe 34 is adapted to open valve 26 near the end of the power stroke and to hold the same open during ascent of the piston on the exhaust stroke until the piston has moved slightly past top dead center. As camshaft lobe 34 continues to rotate, spring 58 forces push rod 38 downwardly and valve 26 is reseated. Valve 26 is held closed during the ensuing intake, compression and power strokes. Intake camshaft lobe 32 is likewise of conventional fixed configuration to control the intake valve such that it closes completely shortly after the piston begins its compression stroke and remains closed throughout the subsequent power and exhaust strokes, reopening to admit the fuel mixture on the intake stroke.

Since in a conventional engine, the intake and exhaust valves are normally closed for the major portion of the compression stroke, cranking of the engine would be difficult unless some provision is made to vent combustion chamber 20 during part or all of the compression stroke during cranking of the engine. However, by modifying a conventional engine to incorporate the improved compression release mechanism in accordance with the present invention, compression relief is automatically obtained at cranking speeds to greatly reduce cranking effort and thereby facilitate starting. In addition, the mechanism is responsive to engine speed such that it is automatically rendered inoperative at engine running speeds so that there is no compression loss to decrease the efficiency of the engine when it is running under its own power.

Figure 2:
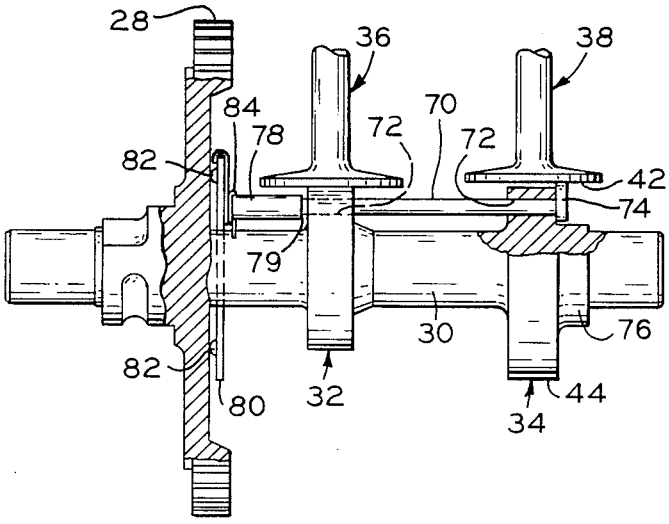
FIG. 2 is a fragmentary side elevational view taken partially in section, illustrating the compression release mechanism and associated engine parts.
Figure 3:
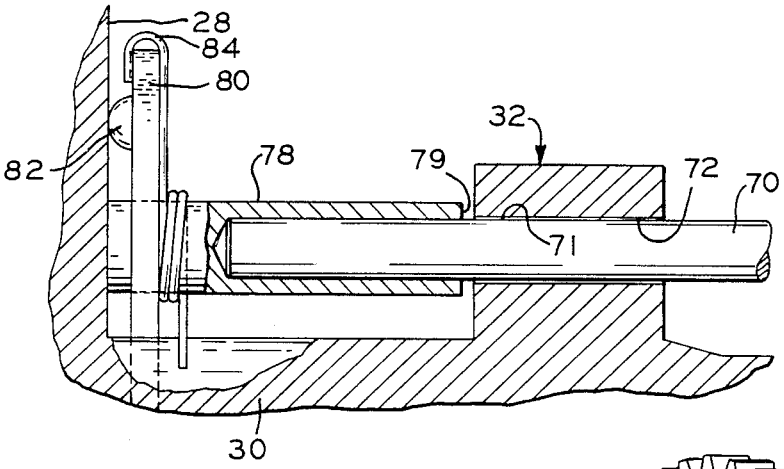
FIG. 3 is an enlarged sectional view of a portion of the camshaft showing the location of the flyweight, spring and pin relative to the cam gear and the inboard lobe.
Figure 4:
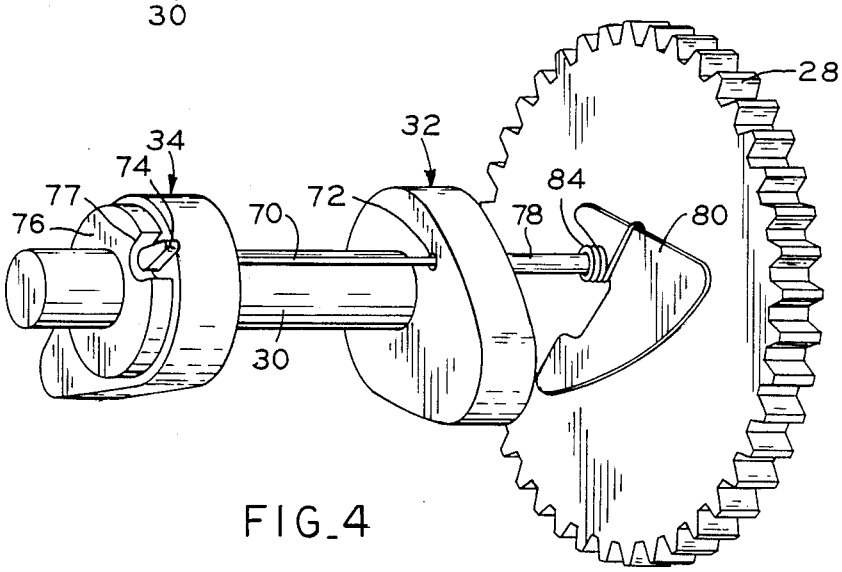
FIG. 4 is a perspective view of the compression release mechanism of the present invention, showing its relation to the camshaft and the camshaft gear.

Referring to the drawings, and particularly to FIGS. 2 and 4, the compression release mechanism of the present invention is shown. A rotatable pin 70 having outer bearing surface 71 is positioned axially parallel to camshaft 30. Pin 70 is of cold headed construction, and is rotatably received in axially aligned bearing passages 72 formed in respective inboard and outboard cam lobes 32, 34. Auxiliary cam 74 having cam surface 75 is mounted at an axial end of pin 70. Portion 76 of cam lobe 34 is positioned axially outward of outboard cam lobe 34, and includes groove 77 that provides a seat for auxiliary cam 74 (FIG. 4) and allows room for cam 74 to rotate in a manner to be described. The other axial end of pin 70 is pressed into a cylindrical hub 78 extending in a generally perpendicular direction from flyweight 80. Hub 78 may be integral with flyweight 80, or may be attached thereto in a suitable manner. A frictional connection is formed between hub 78 and pin 70 such that a unitary connection is formed. The auxiliary cam assembly, consisting of rotatable pin 70, auxiliary cam 74, hub 78 and flyweight 80, respectively, is retained in its position shown in the drawings relative to camshaft 30 by end 79 of hub 78, positioned adjacent inboard lobe 32, which limits movement of the assembly in the outboard direction. This is best illustrated in FIG. 3 of the drawings. Since the diameter of hub 78 is greater than the diameter of bearing passage 72 through inboard lobe 32, the entire auxiliary cam assembly is thus prevented from outward movement. Thus, auxiliary cam 74 remains in alignment with flat underface 42 of the outboard valve lifter.

Figure 6:
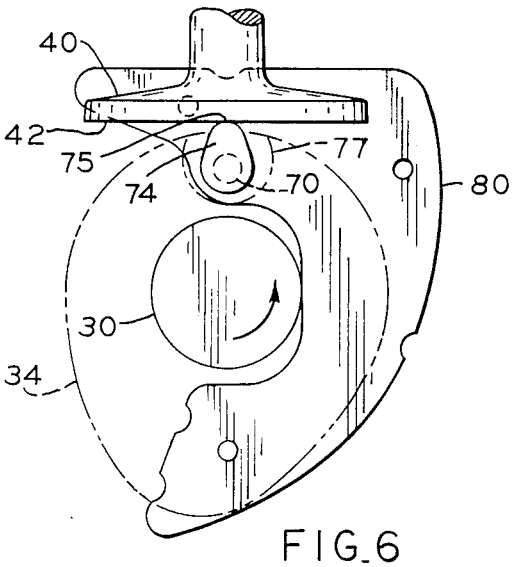
FIG. 6 is a sectional view showing the flyweight and auxiliary cam surface positioned in the start position.
Figure 7:
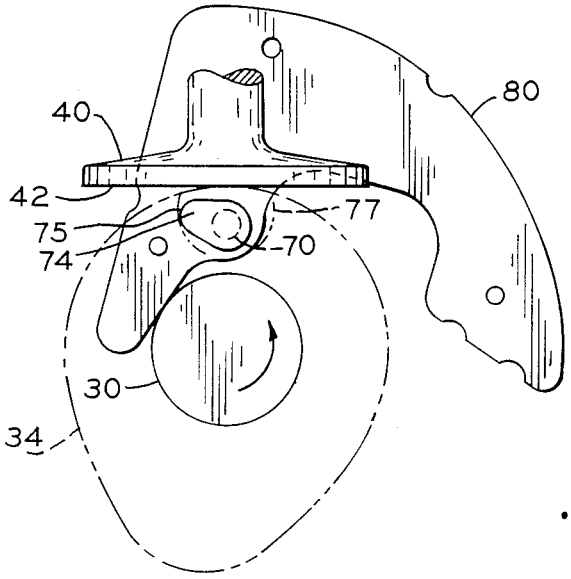
FIG. 7 is a sectional view showing the flyweight and auxiliary cam surface positioned in the run position.

Flyweight 80 is, preferably, of sintered metal construction and is positioned between inboard lobe 32 and camshaft gear 28. Flyweight 80 is generally perpendicular to rotatable pin 70. Protrusions 82 provide thrust support for one face of flyweight 80 against camshaft gear 28. Flyweight 80 has a generally C-shaped body, as shown in FIGS. 6 and 7, and is movable about the axis of camshaft 30 in a manner to be described. A resilient means such as coil spring 84 is positioned around cylindrical hub 78 with one end extending out and bearing against flyweight 80, and the other end extending out and bearing against camshaft 30 in the area between inboard camshaft lobe 32 and camshaft gear 28 as best shown in FIG. 2. Coil spring 84 is preloaded so that flyweight 80 and rotating pin 70 are biased to their start position, as shown in FIGS. 4 and 6, when the engine is at standstill, or running at less than normal operating speed. Rotatable pin 70 and flyweight 80 are positioned such that they revolve around camshaft 30 as the camshaft is rotated during operation of the engine.

The operation of the above-described compression relief mechanism is entirely automatic and determined by engine speed. To start the engine the operator manually cranks the engine in the usual manner, such as with a pull rope starter, to turn the engine over at a relatively low cranking speed. As stated, the preload of spring 84 biases flyweight 80 to the position shown in FIGS. 4 and 6. With flyweight 80 in this position, rotatable pin 70 and auxiliary cam 74 are situated such that cam surface 75 extends radially outwardly above outboard camshaft lobe 34. During initial cranking of the engine, as camshaft 30 rotates at a relatively low speed, cam surface 75 engages flat underface 42 of follower 40 during each rotation of camshaft 30, which lifts exhaust valve 26 slightly off its seat for a portion of each compression stroke. Exhaust valve 26 will thus be partially reopened on every compression stroke as long as the engine speed does not exceed cranking speed, thereby venting a portion of the previously inducted fuel/air mixture through exhaust passage 24 to thereby relieve compression during starting.

As soon as the engine has started and is running under its own power, the rotational speed of camshaft 30 increases above cranking speed, and flyweight 80, as it revolves with camshaft 30, overcomes spring 84 and pivots outwardly from the start position as shown in FIG. 6 to the run position as shown in FIG. 7. Spring 84 and flyweight 80 may be preloaded to produce this movement in a predetermined range, for example, from 800 to 900 rpm. This movement of the flyweight simultaneously rotates pin 70 and attached auxiliary cam 74 from the position shown in FIGS. 1, 2, 4 and 6 of the drawings, to the run position shown in FIG. 7. The direction of rotation of rotatable pin 70 is designed such that the friction caused by the relative movement between cam surface 75 and valve lifter underface 42 does not induce rotatable pin 70 and flyweight 80 to rotate into the disengaged running position shown in FIG. 7. The rotation of pin 70 causes cam surface 75 to retreat into grooved portion 77 of shoulder 76, and thereby no longer extend radially outwardly above the level of outboard camshaft lobe 34. Thus, valve 26 is no longer partially opened by the action of cam surface 75 and thereafter functions in the conventional manner when the engine is running under its own power. Hence, exhaust valve 26 will be closed throughout every compression stroke at these speeds so that the engine can develop its maximum power output.

As the engine is brought to a stop, the centrifugual force acting on flywheel 80 is no longer strong enough to overcome the bias acting on flyweight 80 by spring 84, and flyweight 80 will return to the position shown in FIG. 6.

Figure 5:
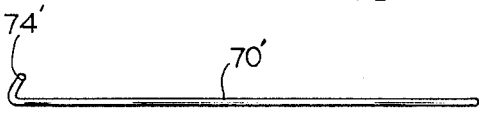
FIG. 5 is a view of a modified rotatable pin.

FIG. 5 shows an alternative design for rotatable pin 70' that may be substituted for rotatable pin 70 and auxiliary cam 74. This design comprises essentially a pin of wireform construction that is bent inwardly at an axial end thereof to an angle of approximately 90°. End 74' acts upon follower 40 in the same manner as auxiliary cam surface 75. In another alternate embodiment, the compression relief mechanism may be positioned to actuate the inboard camshaft lobe, rather than the outboard lobe as shown in the drawings. Although the invention is shown incorporated in a side valve engine, it could also be used in an overhead valve engine.

It will be appreciated that the foregoing has been presented by way of illustration only, and not by way of any limitation, and that various other alternatives and modifications may be made to the illustrated embodiment without departing from the spirit and scope of the invention.

What is claimed is:

1. In an internal combustion engine having a combustion chamber, intake and exhaust valve means operable to respectively control the flow of a fuel/air mixture into the combustion chamber and the exhaust of gases therefrom, said intake and exhaust valve means including respective intake and exhaust valve lifters, a rotatable camshaft having a camshaft gear fixed thereon, and inboard and outboard camshaft lobes fixed on said camshaft, said inboard lobe being positioned axially on said camshaft between said camshaft gear and said outboard lobe, said inboard and outboard camshaft lobes being operable to engage the respective valve lifters to actuate said intake and exhaust valve means, a compression release mechanism comprising:

a rotatable pin having a bearing surface rotatably received in said inboard and outboard camshaft lobes, said pin having a cam surface thereon and position adjacent said outboard lobe, said cam surface being adapted to extend above said outboard lobe to engage one of said valve lifters when said engage said valve lifter when said revolvable pin is rotated to a second position in response to high engine speed, and a flyweight means connected to said rotatable pin and positioned between said inboard camshaft lobe and said camshaft gear, said flyweight means being revolvable with said camshaft for rotating said pin cam surface to said first position below a threshold engine speed and for rotating said pin cam surface to said second position above said threshold engine speed, said pin being enclosed by both said cam lobes over greater than 180° of the pin bearing surface, whereby said pin is retained at two points along its axis against centrifugal forces produced by the rotating camshaft.

2. The engine of claim 1, wherein said flyweight means comprises a centrifugally activated weight adapted to pivot in a plane substantially perpendicular to said camshaft in response to said engine speed, said pivoted movement imparting said rotational movement to said pin.

3. The engine of claim 2, including a spring means for biasing said weight radially inward to oppose centrifugal force on the weight when the engine is operating below the threshold speed so that said rotatable pin is held in its first position.

4. The engine of claim 1, wherein said flyweight means includes a hub axially aligned with and frictionally receiving said other axial end of the rotatable pin so that a unitary connection is formed therebetween.

5. The engine of claim 2, wherein said weight is disposed adjacent a first face of the camshaft gear, said first face providing thrust bearing support for said weight.

6. The engine of claim 1, wherein said rotatable pin is parallel to said camshaft and is rotatably received in and extends through axially aligned passages in said inboard and said outboard camshaft lobes.

7. The engine of claim 1, wherein said inboard camshaft lobe is operable to actuate said intake valve, and said outboard camshaft lobe is operable to actuate said exhaust valve.

8. The engine of claim 7, wherein said cam surface of said rotatable pin is operable to actuate said exhaust valve when said engine is operating below said threshold speed.

9. A compression relief mechanism in an internal combustion engine comprising:

a rotatable camshaft having a camshaft gear fixed thereon, and inboard and outboard camshaft lobes fixed on said camshaft, said inboard lobe being positioned axially on said camshaft between said camshaft gear and said outboard lobe, a rotatable pin axially parallel to said camshaft and having a bearing surface, said pin being rotatably received in said inboard and outboard camshaft lobes so that said pin revolves with said camshaft, said pin having a cam surface mounted on an end portion thereof and positioned adjacent said outboard lobe, said cam surface being adapted to extend above said outboard lobe when said rotatable pin is rotated to a first position in response to low engine speed, and which is below said outboard lobe when said rotatable pin is rotated to a second position in response to high engine speed, a flyweight means connected to the other end portion of said rotatable pin and positioned between said inboard camshaft lobe and said camshaft gear, said flyweight means being revolvable with said camshaft for rotating said pin cam surface to said first position below a threshold engine speed and for rotating said pin cam surface to said second position above said threshold engine speed, and a compression relief valve opened during at least a portion of each compression stroke of said engine by said cam surface when said cam surface is extended radially outward above said outboard lobe, said pin being enclosed by both said cam lobes over greater than 180° of the pin bearing surface, whereby said pin is retained at two points along its axis against centrifugal forces produced by the rotating camshaft.

10. The compression relief mechanism of claim 9, wherein said flyweight means comprises a centrifugally activated weight adapted to pivot in a plane substantially perpendicular to said camshaft in response to the threshold engine speed, said pivoted movement imparting said rotational movement to said pin.

11. The compression relief mechanism of claim 10, including a spring means for biasing said weight radially inward to oppose centrifugal force on the weight when the engine is operating below the threshold speed so that said rotatable pin is held in its first position.

12. The compression relief mechanism of claim 9, wherein said flyweight means includes a hub axially aligned with and receiving said other axial end of the rotatable pin so that a unitary connection is formed therebetween.

13. The compression relief mechanism of claim 10, wherein said weight is disposed adjacent a first face of the camshaft gear, said first face providing thrust bearing support for said weight.

14. The compression relief mechanism of claim 9, wherein said rotatable pin is rotatably received in axially aligned passages in said inboard and said outboard camshaft lobes.

15. The compression relief mechanism of claim 9, wherein said inboard camshaft lobe is operable to actuate said intake valve, and said outboard camshaft lobe is operable to actuate said exhaust valve.

16. The compression relief mechanism of claim 15, wherein said cam surface of said rotatable pin is operable to actuate said exhaust valve when said engine is operating below said threshold speed.

17. In an internal combustion engine having a combustion chamber, intake and exhaust valve means operable to respectively control the flow of a fuel/air mixture into the combustion chamber and the exhaust of gases therefrom, said intake and exhaust valve means including respective intake and exhaust valve lifters, a rotatable camshaft having a camshaft gear fixed thereon, and inboard and outboard camshaft lobes fixed on said camshaft, said inboard lobe being positioned axially on said camshaft between said camshaft gear and said outboard lobe, said inboard and outboard camshaft lobes being operable to engage the respective valve lifters to actuate said intake and exhaust valve means, a compression release mechanism comprising:

a rotatable pin axially parallel to said camshaft and having a bearing surface, said pin being rotatably received in axially aligned passages in said inboard and outboard camshaft lobes, said pin having a cam surface mounted at an axial end thereof and positioned adjacent said outboard lobe, said cam surface being adapted to extend above said outboard lobe to engage one of said valve lifters when said rotatable pin is rotated to a first position in response to low engine speed, and which is below said outboard lobe so as not to engage said valve lifter when said rotatable pin is rotated to a second position in response to high engine speed, a centrifugally activated weight adapted to pivot in a plane substantially perpendicular to said camshaft in response to said engine speed, said pivoted movement imparting said rotational movement to said pin, and spring means for biasing said weight radially inward to oppose centrifugal force on the weight when the engine is operating below the threshold speed so that said rotatable pin is held in its first position, said pin being enclosed by both said cam lobes over greater than 180° of the pin bearing surface, whereby said pin is retained at two points along its axis against centrifugal forces produced by the rotating camshaft.

18. The engine of claim 17, wherein said inboard camshaft lobe is operable to actuate said intake valve, and said outboard camshaft lobe is operable to actuate said exhaust valve.

19. The engine of claim 18, wherein said cam surface of said rotatable pin is operable to actuate said exhaust valve when said engine is operating below threshold speed.

20. The mechanism of claim 1 wherein said pin bearing surface is enclosed by both said cam lobes over 360° of the pin bearing surface.

* * * * *

UNITED STATES PATENT AND TRADEMARK OFFICE

CERTIFICATE OF CORRECTION

PATENT NO. : 4,977,868

DATED : December 18, 1990

INVENTOR(S) : Mark T. Holschuh

It is certified that error appears in the above-identified patent and that said Letters Patent is hereby corrected as shown below:

Claim 1, column 6, line 58, after "said" insert --rotatable pin is rotated to a first position in response to low engine speed, and which is below said outboard lobe so as not to--.

Signed and Sealed this

Twenty-third Day of June, 1992

*Attest:*

DOUGLAS B. COMER

*Attesting Officer*

*Acting Commissioner of Patents and Trademarks*